United States Patent [19]

Miczka

[11] Patent Number: 4,801,046

[45] Date of Patent: Jan. 31, 1989

[54] PRESSURE CONTAINER FOR RECEIVING AND MIXING AT LEAST TWO SEPARATE COMPONENTS

[76] Inventor: Lothar Miczka, Feldwiesenstrasse 22, Altstätten, Switzerland

[21] Appl. No.: 59,922

[22] Filed: Jun. 9, 1987

[30] Foreign Application Priority Data

Jun. 10, 1986 [CH] Switzerland ..... 2342/86

[51] Int. Cl.[4] ..... B65D 35/28

[52] U.S. Cl. ..... 222/95; 222/136; 222/389; 222/485

[58] Field of Search ..... 239/304, 322; 222/129, 222/131, 136–137, 145, 183, 282–283, 330, 386, 387, 389, 391, 394, 478, 481, 482–483, 484–485, 92, 94–95, 105

[56] References Cited

U.S. PATENT DOCUMENTS

| | | | |
|---|---|---|---|
| 3,335,913 | 8/1967 | Bouet | 222/95 |
| 3,452,906 | 7/1969 | Daniels | 222/568 X |
| 3,477,195 | 11/1969 | Chambers | 222/394 X |
| 3,575,319 | 4/1971 | Safianoff | 222/135 |
| 4,136,802 | 1/1979 | Mascia et al.* | 222/95 |
| 4,159,789 | 7/1979 | Stoody | 222/148 |
| 4,189,069 | 2/1980 | Stoody | 222/83.5 |
| 4,556,156 | 12/1985 | Frutin | 222/386.5 |

FOREIGN PATENT DOCUMENTS

| | | | |
|---|---|---|---|
| 1418581 | 10/1965 | France | 239/304 |
| 1570600 | 6/1969 | France | 222/95 |

*Primary Examiner*—Michael S. Huppert
*Attorney, Agent, or Firm*—Helfgott & Karas

[57] ABSTRACT

A container includes a vertical main cylindrical container open at an upper end and at least two vertical internal containers disposed side by side in the main container. A double wall cover closes the upper end of the main container. The cover includes at least two neck portions one disposed below the other. Each neck portion has an outer periphery of the same shape as the periphery of the open end of the main container. The cover has a plurality of openings equal in number to the pluraity of internal containers, each opening being connected to the open end of the corresponding container. A plurality of discharge valves equal in number to the plurality of the internal containers are provided. A piston is provided in the main container. Each valve is coupled to a corresponding opening and extends above the cover in the direction of the axis of the main container. An adapter head is secured to both valves and has manually operative means for simultaneously opening and closing both valves whereby when each internal container which contains a different gaseous and/or flowable component is compressed by the piston and the opening of the valves enables the components to be mixed, the mixture being discharged through the adapter head.

11 Claims, 4 Drawing Sheets

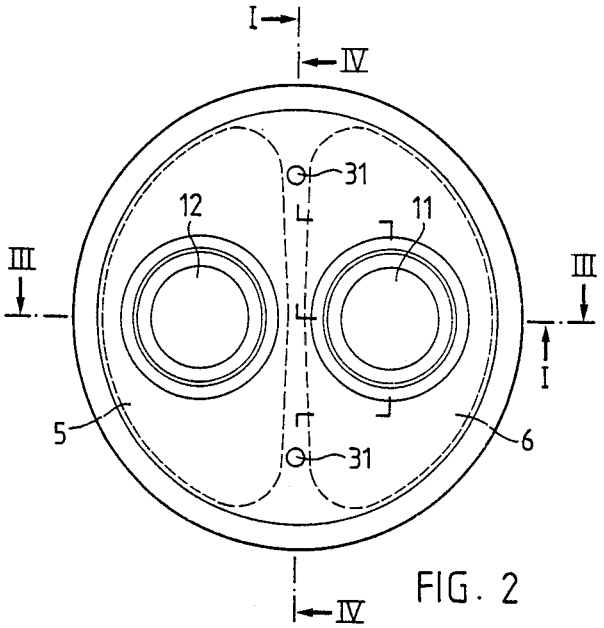
FIG. 2
FIG. 5
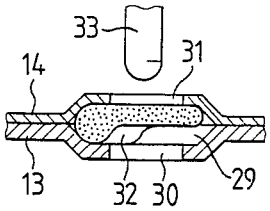
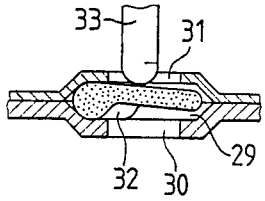
FIG. 6
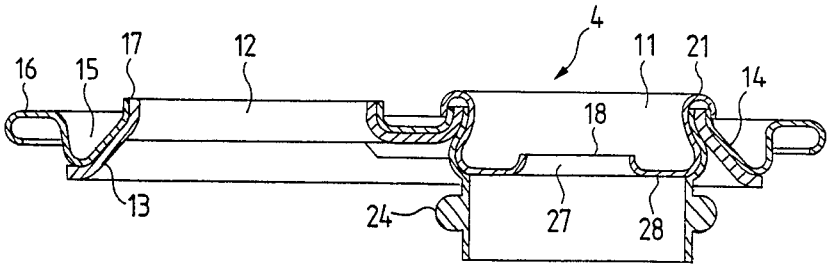
FIG. 3
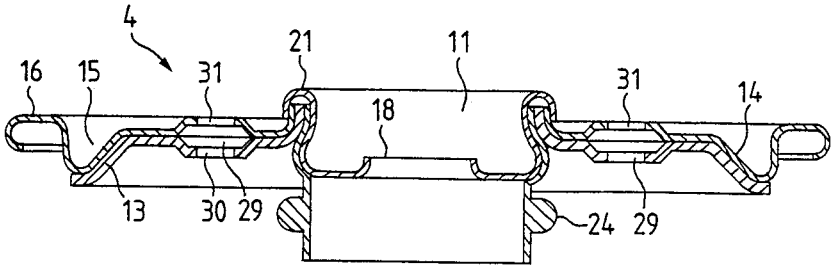
FIG. 4

PRESSURE CONTAINER FOR RECEIVING AND MIXING AT LEAST TWO SEPARATE COMPONENTS

BACKGROUND OF THE INVENTION

The invention relates to a container for receiving gaseous and/or flowable components pressurized in at least two separate containers provided with a discharge valve and wherein the components are mixed on discharging by means of a blowing or foaming medium. The container has a frame or body having a bottom end face and a top end with a cover.

In addition to the known pressurized containers for the removal of a single flowable phase, as shown in U.S. Pat. No. 2,662,668, pressurized containers are also known (PCT WO No. 84/01355), in which several components are housed in separate inner smaller containers and are only mixed just prior to processing by forming a connection between the separately stored components, discharge taking place as a mixture through a single dosing valve. It is a disadvantage of this construction that on the one hand uniform mixing of the components is not ensured and on the other the mixing carried out in the container is subject to changes if the container content is not completely processed immediately on mixing the components.

In another type of pressurized container, the disadvantage is overcome by placing the components in separate inner smaller containers by only mixing the partial quantities of the components required for discharge purposes, but then other problems occur. In particular, throughout the emptying process, the components are to be mixed with a constant mixing ratio, which presupposes that the compressive load or the compressive load ratio on the individual containers remains unchanged, i.e. during the pressurized container emptying process changes to the shape and position do not lead to any modification of the mixing ratio. It is also necessary for the discharge valves of the individual containers to be arranged in the cover of the container, it being desirable to be able to use standardized valves. However, this is not possible in practice with the generally used convex cover. Reference is made in this connection to the simultaneously filed industrial property right of the Applicant relating to the construction of the container cover (BE No. 21 180), which is considered to supplement the present invention.

SUMMARY OF THE INVENTION

It is a primary object of the invention to provide a pressurized container of the aforementioned type so constructed that it can be exposed to the action of a high pressure for maintaining a constant mixing ratio.

Another object is to provide a pressurized container wherein standardized discharge valves are employed for sealing the individual containers and wherein the mixing ratio of the components can be adapted in simple manner to the required ratio value.

In accordance with the principles of the invention a container is provided with a vertical hollow cylindrical body open at an upper end and being otherwise sealed. At least two vertical spaced smaller containers are disposed side by side in the body, each smaller individual container being open at an upper end and being otherwise sealed, the open ends of the smaller container being adjacent the open end of the body. The container also is provided with a cover including at least two neck portion, the neck portions being disposed one below the other and extending generally at right angles to the axis of the body. Each neck portion has an outer periphery of the same shape as the periphery of the open end of the body, the periphery of the upper neck portion being sealed to the periphery of the open end. The cover has a plurality of openings equal in number to the plurality of individual containers, each opening being connected to the open end of the corresponding individual container.

The container is also provided with a plurality of discharge valves equal in number to the plurality of individual containers. Each valve is coupled to a corresponding opening and extends above the cover in the direction of the axis of the body. An adapter head is secured to both valves and has manually operative means for simultaneously opening and closing both valves when each individual container contains a different gaseous and/or flowable component and the body is pressurized, opening the valves enables the components to be mixed, the mixture being discharged through the head.

In the invention, the cover is constructed as a wall comprising at least two superimposed, attached neck portions, in which openings corresponding to the number of individual containers are provided for receiving the outlets associated with the individual containers and which are connected to an adapter head for the simultaneous operation of the outlets and for setting the mixing ratio of the components.

Appropriately the cover is constructed as an e.g. partly profiled, but substantially disk-shaped wall, in which an inner neck portion has a smaller diameter than the outer neck portion associated with the inner neck portion. Due to the double wall, an adequate strength is obtained, even without a convex shape and in addition the flanging of the cover with the body edge using the edge of the larger diameter outer neck portion projecting over the inner neck portion is simplified.

The aforementioned objects and advantages of the invention as well as other objects and advantages thereof will either be explained or will become apparent to those skilled in the art when this specification is read in conjunction with the accompanying drawings and specific description of preferred embodiments which follow.

BRIEF DESCRIPTION OF THE DRAWINGS

FIG. 2 is a top view thereof.

FIG. 3 is sectional view of the cover of the pressurized container as taken along line III—III of FIG. 2.

FIG. 4 is another sectional view through the hopper of the pressurized container as taken along line IV—IV in FIG. 2.

FIG. 5 is a detail view of the section shown in FIG. 4 drawn to a larger scale and provided with a closed venting means.

FIG. 6 is a view similar to FIG. 5 but showing the venting means in closed position.

DETAILED DESCRIPTION OF THE PREFERRED EMBODIMENTS

Figure 1:
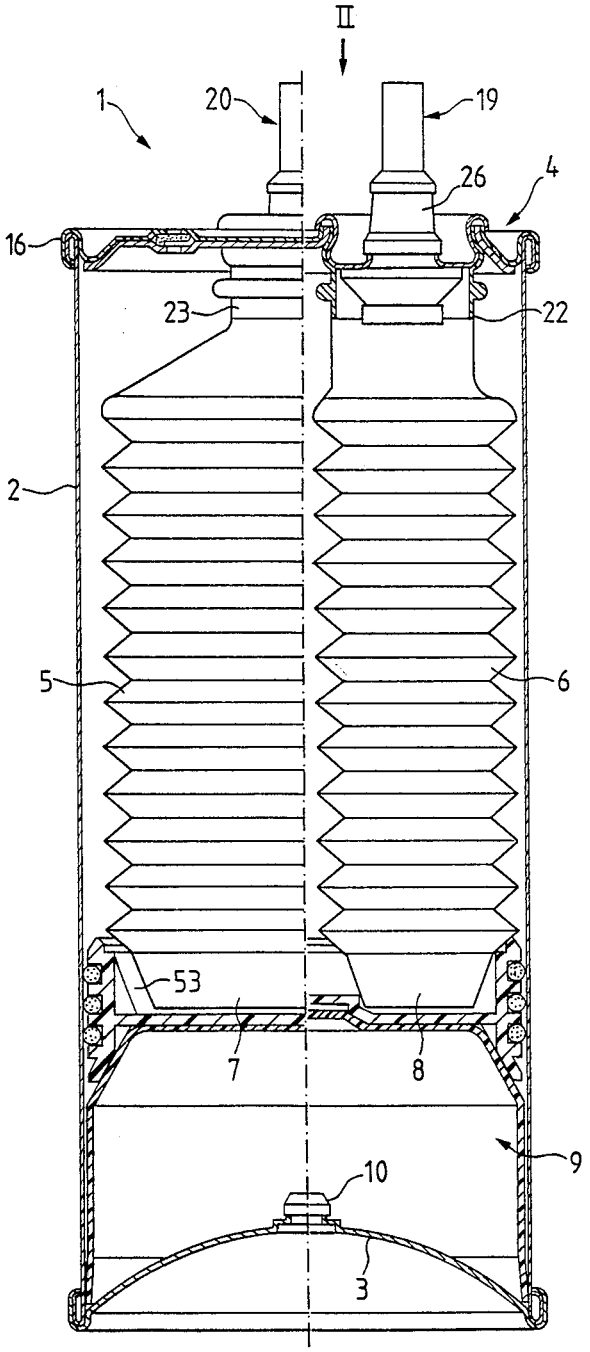
FIG. 1 is a vertical cross section of one embodiment of the invention.
Figure 7:
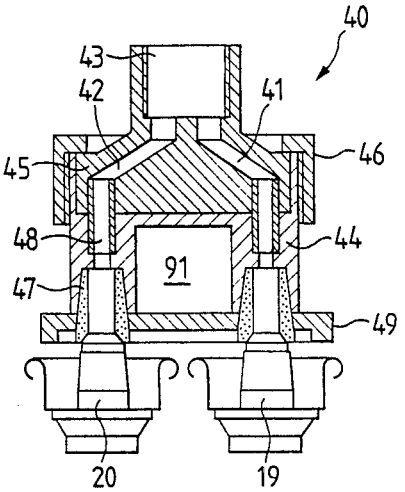
FIG. 7 is a section through an adapter head for receiving the individual container valves.

The pressurized container 1 shown in FIG. 1 comprises a container body or frame 2 manufactured from e.g. tin plate, aluminium, an aluminium alloy, plastic or a composite metal-plastic material. The container is provided with an inwardly curved bottom 3 and a top wall or cover 4. Container 1 houses two individual smaller containers 5, 6, which are made from plastic and whose bottom parts 7, 8 are supported in common on a piston 9. Piston 9 is subjected to the action of a gas propellant filling, which fills the space between piston 9 and bottom 3 and can be filled through a seal 10, e.g. a pressed-in plug or a one-way valve. Neck 4 has two circular openings 11, 12 (shown in FIG. 2), whose construction will be explained hereinafter relative to FIGS. 3 and 4.

As can be seen from FIGS. 3 and 4, cover 4 includes two neck portions, an inner neck portion 13 on the one hand and an outer neck portion 14 on the other. The diameter of the inner neck portion 13 roughly corresponds to the internal diameter of the cylindrical container body 2 and is constructed with a greater wall thickness than the outer neck portion 14. Partial hopper 14 has a larger diameter than inner neck portion 13 and has in the circumferential region a groove 15. The inner neck portion 13 is bonded to the lower surface of the groove. The outer neck portion 14 is circumferentially provided with a flanging part 16, which is used in forming the flanging between the edge of container body 2 and cover 4. Since only one neck portion, and in the present example the outer neck portion 14 is used for said flanging, flanging can be obtained with limited expenditure and in a reliable manner.

As can be gathered from FIGS. 3 and 4, openings 11, 12 are each provided with a raised peripheral rim 17, which is roughly at right angles to the cover plane and is remote from the inner neck portion 13. It is important that rim 17 is formed from both neck portion 13, 14, so that its wall thickness represents the sum of the wall thicknesses of the two neck portions 13, 14 and no additional flanging or beading is required.

Each rim 17 serves to receive a valve disk 18, whose edge curvature 21 embraces the unrolled rim 17 formed from neck portion 13, 14 and is crimped therewith. Thus a reliable connection is formed between valve disk 18 and cover 4.

Each of containers 5, 6 constructed as gusset bags have an upwardly open socket-like bag neck 22, 23, which has a reinforcing bead 24, cf FIGS. 3 and 4. The edge of each of the bag necks 22, 23 is placed under the edge curvature 21 of valve disk 18 over rim 17 of cover 4 and then crimping with the valve disk 18 is carried out. Thus, each of the bag necks 22, 23 forms a reliable seal between cover 4 and a corresponding valve disk 18. Each valve disk 18 carries a corresponding valve 19, 20, with which a complete sealing of each container 5, 6 is ensured. Both valve disks 18 and valves 19, 20 are standard components, which can be used without any modification due to the construction of cover 4.

Each of valves 19, 20 comprise a tubular valve tappet 25 and an elastically deformable valve body 26 engaged in an opening 27 in bottom 28 of valve disk 18. The construction and function of valves 19, 20 is known, cf e.g. U.S. Pat. No. 3,662,926.

The substantially planar cover 4 makes it possible to arrange two or more valves 19, 20 depending upon the number of individual containers 5, 6 used. Because of the use of neck portions 13, 14, cover 4 can even be used for high pressures, while eliminating the need to have to make the wall thickness of the neck portions 13, 14 excessively thick. The neck portions 13, 14 form a stable entity, because they are appropriately interconnected, e.g. by spot welding or bonding. As shown in FIG. 4, between the two neck portions 13, 14 there is formed a cavity 29 provided with passages 30, 31. Cavity 29 can be constructed as a venting means, cf FIGS. 5 and 6, in that an elastically resilient tongue 32 is inserted in cavity 29. Tongue 32 engages on passage 31 of the outer neck portion 14 and is consequently in the closed position, in which the interior of pressure container 1 is sealed in pressure-tight manner. If tongue 32 is moved away from passage 31 by depressing a pin 33 and brought into the open position, cf FIG. 6, a connection is formed between the interior of pressure container 1 and the external air. This venting operating is always necessary on removing components from containers 5, 6 so that the piston 9 subject to the action of the propellant gas filling can perform its lifting movement for emptying containers 5, 6.

When using pressurized container 1, the components must be brought together and mixed prior to the discharge from containers 5, 6. For bringing together the components, an adapter head 40 is provided, which is mounted on valves 19, 20 of containers 5, 6 and has two supply lines 41, 42 issuing into a connecting chamber 43. Into the latter is screwed a not shown mixing tube, in which the components are mixed and brought to the processing point.

Adapter head 40 is constructed in multipart form, being constituted by a body 44 and a head 45 having connecting chamber 43. Head 45 is screwed by means of a box nut 46 onto body 44, which also has a stop plate 49.

For sealing adapter head 40 on valves 19, 20, for each supply line 41, 42 a relatively soft, conical sealing sleeve 47 is inserted in body 44. At the transition between body 44 and head 45, in each case one dosing sleeve 48 is provided in the supply lines 41, 42. Dosing sleeves 48 make it possible to set the mixing ratio of the components, so that they are interchangeable after removing head 45.

Figure 12:
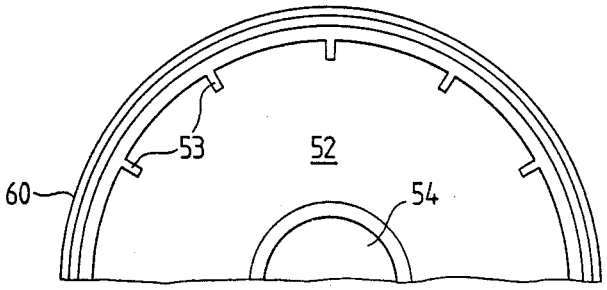
FIG. 12 is a partial plan view of the sealing part taken from direction XII in FIG. 10.

Piston 9 is in two parts, a sealing part 50 on the one hand and a cup-shaped piston part 51 on the other. The two parts 50, 51 are made from plastic and are connected to one another e.g. by bonding or welding. On the inner container side, sealing part 50 has a recess 52, into which project the bottoms 28 of containers 5, 6 and are supported by ribs 53, cf FIGS. 10 and 12. In the center of recess 52 is provided a projection 54, into whose bottom recess projects and is centered a projection 56 of head 59 of piston part 51. A further centering of piston part 51 is achieved by ribs 58, which define a recess 59 facing recess 52. The two recesses 52, 59 are surrounded by a cylindrical wall 60, which has a plurality of circular grooves 61 for receiving packing rings 62.

Figure 10:
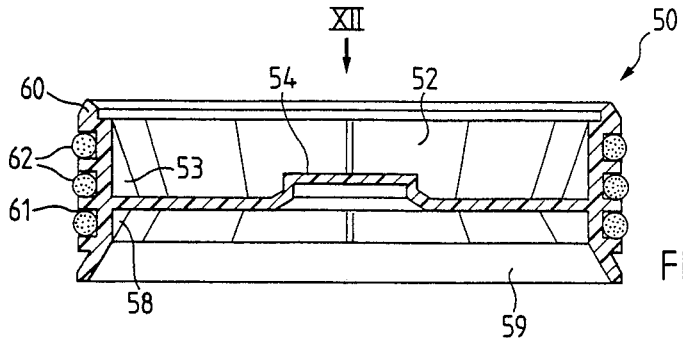
FIG. 10 is a section view through the sealing of a joined piston shown in FIG. 1.

In FIG. 10 there are three packing rings 62, but the number thereof can be modified as desired.

Figure 11:
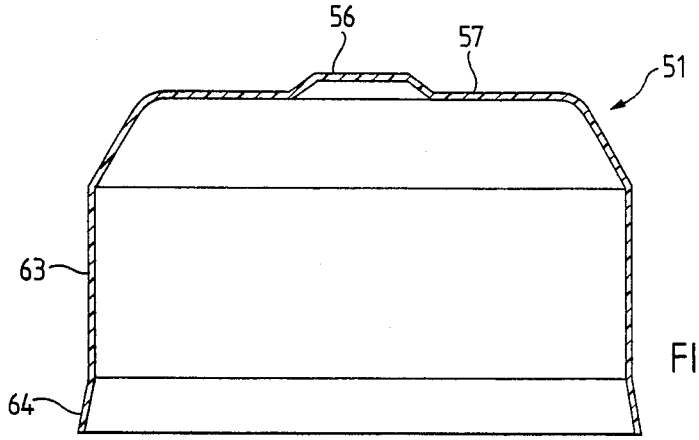
FIG. 11 is a sectional view through the piston shown in FIG. 1.

As shown in FIG. 11, piston part 51 is a relatively thin plastic part, whose piston skirt 63 is provided on its free edge with a conical sealing and guiding lip 64.

For removing the components from containers 5, 6, adapter head 40 is depressed, so that valves 19, 20 are simultaneously and uniformly opened. In accordance with the pressure uniformly exerted on the bottoms 28 of containers 5, 6 by piston 9, the components are delivered to chamber 43 and it is possible for the mixture ratio of the components to be set by dosing sleeves 48.

The ratio of the discharged components can also be set by using containers 5, 6 with different cross-sections. As can be gathered from the two broken lines in FIG. 2, containers 5, 6 have the same cross-section. Dosing sleeves 48 make it possible to modify the ratio of the components to a certain extent. However, if the mixing ratio is large, containers 5, 6 must have different cross-sections. For example, one cross-section can be circular and the other reniform. These possibilities make it possible to vary the mixing ratio within wide limits and can be adapted to the viscosity of the components.

Figure 8:
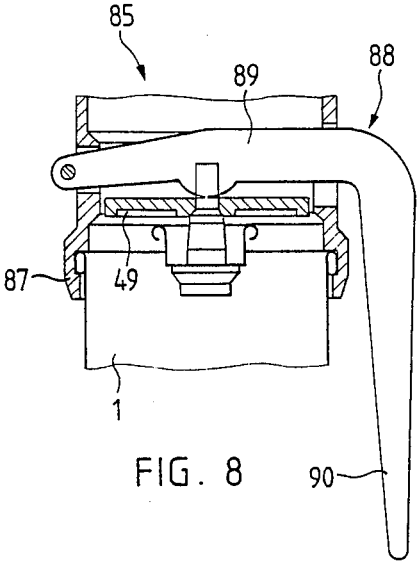
FIG. 8 shows an actuating device for the adapter head.
Figure 9:
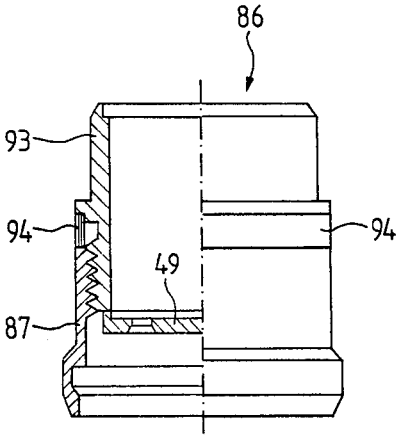
FIG. 9 shows another actuating device for the adapter head.

Actuating means 85, 86 shown in FIGS. 8 and 9 are used for depressing the adapter head 40 during the removal of the components. Both actuating means have a recurring sleeve 87, which is mounted on neck 4 of pressurized container 1 and engages on the cover flanging. As can be gathered from FIG. 8, a bent lever 88 is pivotably mounted at the end of one lever arm 89 on fixing sleeve 87. The other lever arm 90 extends along pressurized container 1 and is used for manually operating the bent lever 88. One lever arm 89 extends through a passage 91 of adapter head 40. Through the depression of bent lever 88, adapter head 40 is depressed, so that valves 19, 20 are opened. On the cover side, two pins 33 are fixed to stop plate 49 of the adapter head 40, cf FIGS. 5 and 6 and on depressing adapter head 40 bring tongues 32 into the open position, so that the interior of pressure container 1 is vented. Adapter head 40 is not shown in FIGS. 8 and 9 and instead, for reasons of clarity, only its cover or valve-side stop plate 92.

According to FIG. 9, actuating means 86 has turn sleeve 93, which is screwed to the fixing sleeve 87. On turn sleeve 93 is also provided a control ring 94, which is destroyed on turning sleeve 93 for opening valves 19, 20 and consequently indicates that pressurized container 1 has already been used.

The pressurized container 1 can be used for a plurality of components. Not only two, but even three and even possibly more components can be housed in the pressurized container 1, the cover surface permitting the arrangement of valves with the aid of standardized valve disks. The strength of cover 4 can be varied through the choice of the wall thicknesses of neck portion 13, 14 as needed to satisfy requirements of the particular case. The neck portions are appropriately made from different materials, as are the container body and container bottom 3. Suitable materials are metals, e.g. tin plate, aluminum and its alloys, plastics with and without reinforcement or composite metal-plastic materials. The parts of the adapter 40 are preferably made from plastic or parts of the adapter 40 are preferably made from plastic or metal, while the actuating means 85, 86 can be made from plastic or metal. In addition, it is possible to vary the dosing ratio within wide limits by using dosing sleeves 48 and containers 5, 6 of different sizes.

Under some conditions pressurized container 1 can be operated without piston 9. In this situation there is no need for passages 30, 31 in hooper 4 or, alternatively the tongues 32 are left in the closed position.

While the fundamental novel features of the invention have been shown and described and pointed out, it will be understood that various substitutions and changes in the form of the details of the emodiments shown may be made by those skilled in the art without departing from the concept of the invention as limited only by the scope of the claims which follow.

What is claimed is:

1. A container for storing and dispensing components being mixed when dispensed from the container, the container comprising:

a vertical main container openable at an upper end thereof and being sealed at all other sides thereof;

at least two vertically extending internal containers disposed side by side in said main container and each containing a different component and being openable at an upper end and sealed at all other sides thereof;

piston means which divides said main container into an upper pressure free chamber, in which said internal containers are positioned, and a lower chamber containing a pressure gas;

a disk-shaped double wall cover having openings in a number equal to the number of said internal containers, said cover enclosing said upper end of said main container and including at least two neck portions disposed one below another and each being substantially disk-shaped, each neck portion having a peripheral rim defining each opening;

at least two discharge valves each extending upwardly from said main container and each having a valve disk crimped to the peripheral rim of the corresponding neck portion;

each internal container being formed as a flexible bag having a neck placed over the peripheral rim of the corresponding neck portion and crimped thereto;

an adapter head secured to each valve and having manually operative means for simultaneously opening and closing each valve; and venting means provided on said cover and manually operated between an open and closed position so as to permit said piston to exert pressure on said internal container under action of pressure gas when said vent means is in said open position in which a connection is established between said upper chamber and atmosphere, said manually operated means of said adapter opening said venting means during the opening of each valve, whereby when said piston exert pressure in said internal containers and said valves are open the component of said internal containers are mixed in said adapter head and are dispensed from said container as a mixture.

2. The container of claim 1 wherein an upper neck portion has a larger diameter than that of a lower neck portion.

3. The container of claim 2, wherein the neck portions have different thicknesses.

4. The container of claim 1 wherein each crimped valve disk forms a seal between the corresponding rim and the valve disk.

5. The container of claim 1, wherein said piston has a plurality of recesses equal in number to the number of the internal containers, each container resting upon the corresponding recess.

6. The container of claim 5 wherein the piston includes a sealing component having said recesses and a cup shaped piston component filled with a propellant gas and having a head jointed to the sealing component.

7. The container of claim 1 wherein each valve has a discharge orifice and the adapter head has a mixing and discharge chamber provided with a plurality of supply lines, each line connecting said mixing and discharge chamber to the corresponding valve orifice.

8. The container of claim 7 wherein each valve has a sealing sleeve and each line has a dosing sleeve.

9. The container of claim 1 wherein the manually operated means includes a first lever which functions as an operating handle and a second lever which extends through a passage in the adapter head and cooperates with the valves.

10. The container of claim 1 wherein the manually operative means includes a turn sleeve with a control ring, the control ring changing a shape when the turn ring is turned to indicate that the container has been used.

11. The container of claim 10, wherein the internal containers have different cross sectional areas and have different volumes.

* * * * *